US005412960A

United States Patent [19]

James et al.

[11] Patent Number: 5,412,960

[45] Date of Patent: May 9, 1995

[54] LOCK STRUCTURE

[75] Inventors: Brent A. James; Garrick D. James, both of Williamsville, N.Y.

[73] Assignee: Diversified Control, Inc., Orchard Park, N.Y.

[21] Appl. No.: 149,329

[22] Filed: Nov. 8, 1993

[51] Int. Cl.[6] ..... E05C 19/10; E05B 65/52

[52] U.S. Cl. ..... 70/63; 292/99; 292/121; 292/DIG. 20; 312/334.32

[58] Field of Search ..... 70/63, 58, 158–173, 70/DIG. 72, 14, 18, 57, 416; 109/53, 54, 56, 57, 45, 8; 206/1.5; 220/210; 312/334.32, 334.33, 349, 350; 292/DIG. 20, 256, 257, 256.5, 99, 121, 122, 124, 126, 128, 198, 220, 224, 228

[56] References Cited

U.S. PATENT DOCUMENTS

| | | | |
|---|---|---|---|
| 163,028 | 5/1875 | Romadka . | |
| 354,459 | 12/1886 | Brooks | 109/45 |
| 625,576 | 5/1899 | Macey | 312/334.32 |
| 832,664 | 10/1906 | Grether | 292/DIG. 20 X |
| 836,810 | 11/1906 | Kapus | 292/DIG. 20 X |
| 976,027 | 11/1910 | Beehler | 292/121 |
| 1,002,259 | 9/1911 | Goedeke | 292/121 |
| 2,326,069 | 8/1943 | Samzelius | 292/128 |
| 2,794,664 | 6/1957 | Kruger | 292/99 X |
| 2,955,861 | 10/1960 | Claud-Mantle | 70/63 X |
| 3,084,008 | 4/1963 | Mallett | 70/63 X |
| 3,391,256 | 7/1968 | Nawman | 70/DIG. 72 X |
| 3,933,240 | 1/1976 | Humble | 70/63 X |
| 4,662,664 | 5/1987 | Wendt et al. | 70/63 X |
| 4,674,306 | 6/1987 | Halpern | 70/DIG. 57 X |
| 4,947,661 | 8/1990 | Yoshida | 70/57 |
| 4,953,374 | 9/1990 | Wiebe | 70/416 |
| 5,248,195 | 9/1993 | Shin | 312/334.33 |

FOREIGN PATENT DOCUMENTS

| | | | |
|---|---|---|---|
| 2849829 | 6/1979 | Germany | 292/121 |

*Primary Examiner*—Peter M. Cuomo
*Assistant Examiner*—Suzanne L. Dino
*Attorney, Agent, or Firm*—Joseph P. Gastel

[57] ABSTRACT

A lock structure for use on an enclosure having first and second sections which are assembled and disassembled by a relative rectilinear telescopic sliding engagement including a first channel having a first web and a first pair of legs secured to the first section, a latch pivotally mounted on the first channel and being biased by a spring to a locking position, a second channel having a second web and a second pair of legs secured to the second section so that the first pair of legs fit between the second pair of legs when the first and second sections are being moved into assembled relationship, and an end on one of the second legs for functioning as a keeper for the latch when the first and second sections are in fully assembled relationship.

9 Claims, 4 Drawing Sheets

LOCK STRUCTURE

BACKGROUND OF THE INVENTION

The present invention relates to a lock structure for utilization on parts of an enclosure which are assembled by a rectilinearly telescoping sliding movement.

By way of background, there are in use enclosures known as pedestals which are housings for cable TV and telephone junctions which are located outside of a dwelling. These enclosures have a bottom section, which is partially embedded in the ground, and a top section which fits thereon by a rectilinearly telescopic sliding motion. In the past various devices were utilized to lock these two sections together, and these devices included padlocks and built-in key locks. The padlocks were deficient in that they required conventional types of small keys, and the built-in key locks were deficient in that they did not prevent the locks from being disengaged by rocking the top section relative to the bottom section. Furthermore, both types of locks were deficient in that they utilized keys of the conventional type which were easily lost.

SUMMARY OF THE INVENTION

It is accordingly one object of the present invention to provide a lock structure for two recilinearly movable parts which can be unlatched by the use of a specialized key which is not easily lost.

Another object of the present invention is to provide a lock structure in the nature of a latch which is automatically moved to a locking condition merely on assembling of the rectilinearly slidable sections.

A further object of the present invention is to provide a latch structure which is uniquely integrated with channel members which prevent the latch structure from being disengaged by rocking the relatively movable sections, and which channel structure aids in aligning the relatively movable sections during assembling thereof. Other objects and attendant advantages of the present invention will readily be perceived hereafter.

The present invention relates to a lock structure for an enclosure having first and second sections which are assembled and disassembled by a relative rectilinear sliding engagement, the lock structure comprising a first channel having a first web and a first pair of legs secured to said first section, a latch, pivot means pivotally mounting said latch on said first channel, spring means biasing said latch to a locking position, a second channel having a second web and a second pair of legs secured to said second section, said first pair of legs fitting between said second pair of legs and being located between said first and second webs when said first and second sections are being rectilinearly moved into assembled relationship and after said first and second sections are in fully assembled relationship, and an end on one of said second legs for functioning as a keeper for said latch when said first and second sections are in fully assembled relationship.

The various aspects of the present invention will be more fully understood when the following portions of the specification are read in conjunction with the accompanying drawings wherein:

DESCRIPTION OF THE PREFERRED EMBODIMENTS

Figure 1:
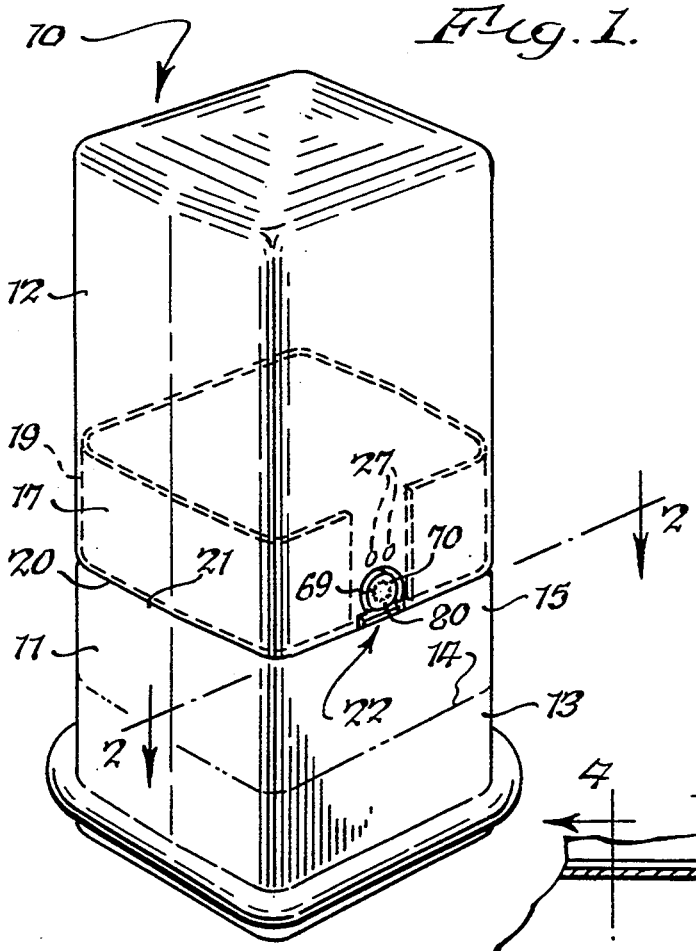
FIG. 1 is a perspective view of an enclosure wherein the top and bottom sections are assembled and disassembled by a rectilinear telescopic sliding motion.
Figure 10:
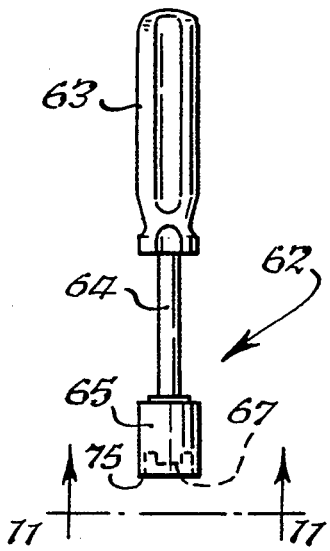
FIG. 10 is a side elevational view of the key which is utilized for unlatching the lock structure.

By way of background, there are in use enclosures 10 which are known as "splitters" which are pedestals for cable TV and telephone junctions. These enclosures include a lower section 11 and an upper section 12. The lower section 11 is placed in the ground so that the lowermost portion 13 is below the ground line 14 and the upper portion 15 extends above the ground. The upper section 12 has a lower portion 17 which is mounted on the upper portion 19 of lower section 11 by a rectilinear sliding motion, and the end 20 of upper section 12 comes to rest on ledge 21 of lower section 11.

In the past various types of lock structures were utilized to maintain the upper and lower sections in locked condition. These prior structures either utilized padlock arrangements of various types or utilized built-in locks which required conventional keys. Neither of these were satisfactory because the padlock type were frequently left unlocked or could be easily "picked." The conventional built-in lock structures utilizing keys could also be easily "picked", and further required conventional keys which could easily be lost or duplicated. Also, structures which used built-in locks could be unlocked by rocking the upper section relative to the lower section.

The lock structure 22 of the present invention possesses a plurality of advantages over the prior types of lock structures. More specifically, locking is effected incidental to the rectilinear, telescopic, sliding motion which is utilized to assemble the top section 12 onto bottom section 11. Furthermore, the lock structure itself aids in guiding the section 12 during its rectilinear motion. Additionally, unlocking cannot be effected by rocking the top section 12 relative to the bottom section 11. Also, the lock structure can be opened by means of a key having an overall shape which resembles a screwdriver but which has an end which fits into a curvilinear groove of the lock structure.

Figure 4:
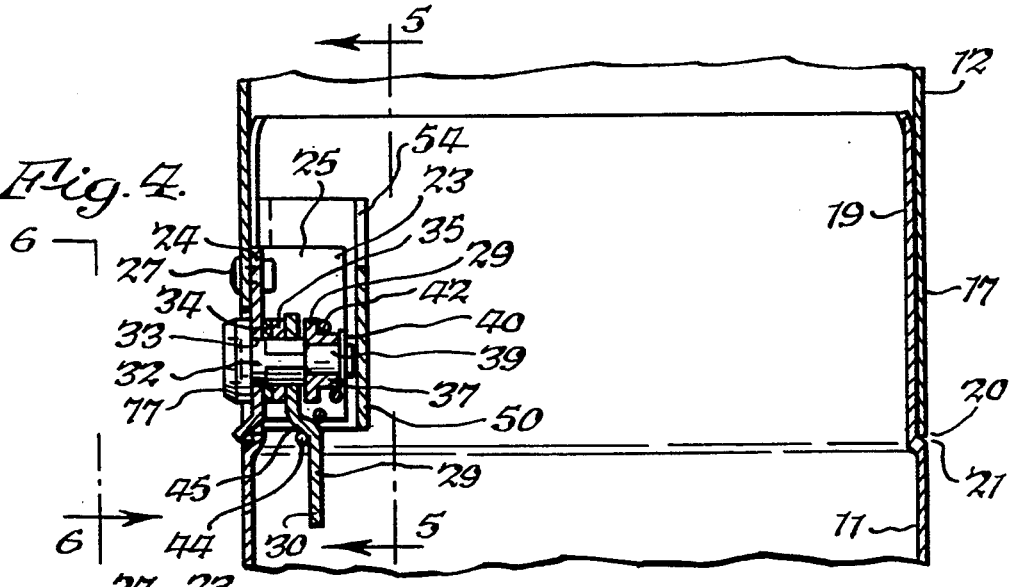
FIG. 4 is a fragmentary cross sectional view taken substantially along line 4—4 of FIG. 2.
Figure 5:
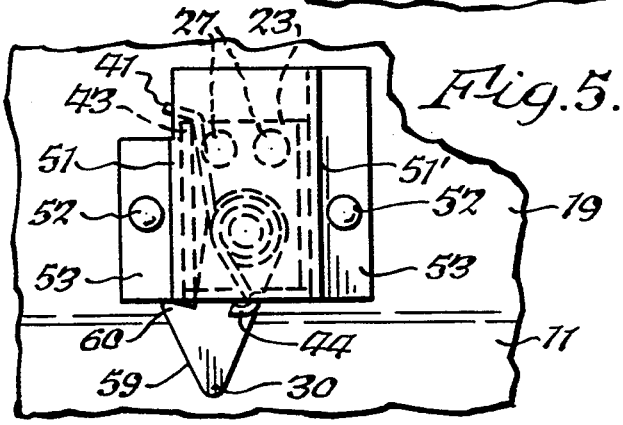
FIG. 5 is a fragmentary view taken substantially in the direction of arrows 5—5 of FIG. 4 and showing the lock structure in side elevation.
Figure 7:
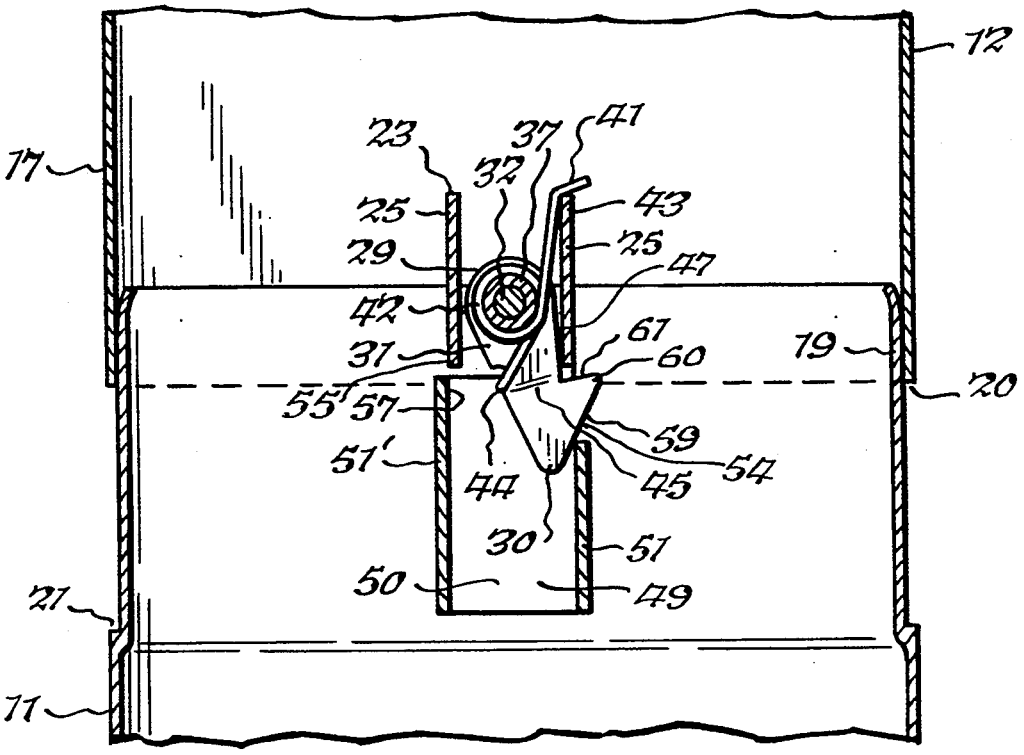
FIG. 7 is a fragmentary cross sectional view taken substantially along line 3—3 of FIG. 2 but showing the lock structure with the parts at the initial portion of their engagement.
Figure 8:
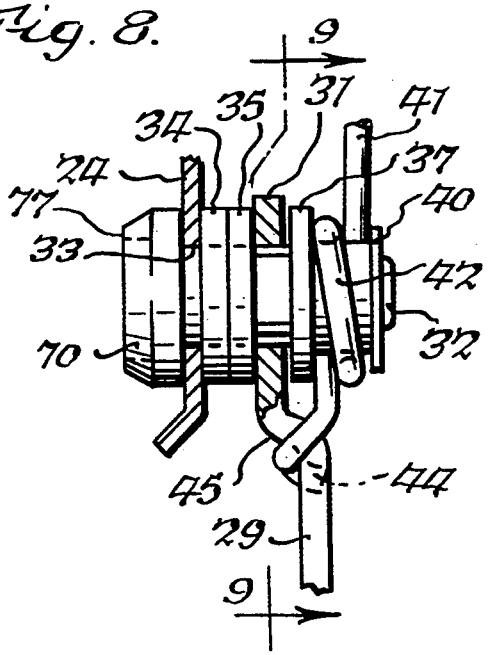
FIG. 8 is a fragmentary enlarged view of a portion of FIG. 4.
Figure 9:
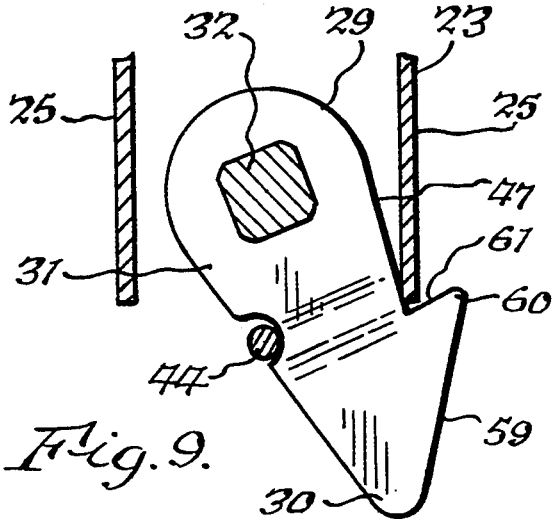
FIG. 9 is a fragmentary cross sectional view taken substantially along line 9—9 of FIG. 8.
Figure 12:
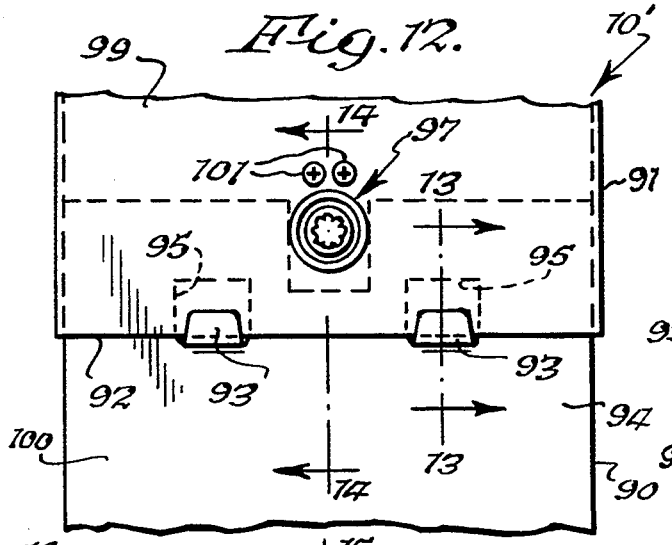
FIG. 12 is a fragmentary front elevational view of a modified embodiment of the present invention.
Figure 13:
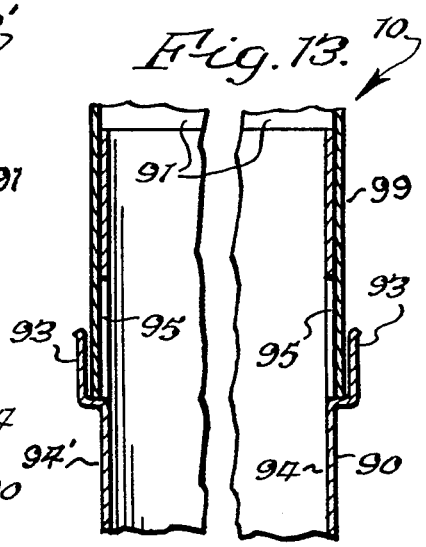
FIG. 13 is an enlarged fragmentary cross sectional view taken substantially along line 13—13 of FIG. 12.
Figure 14:
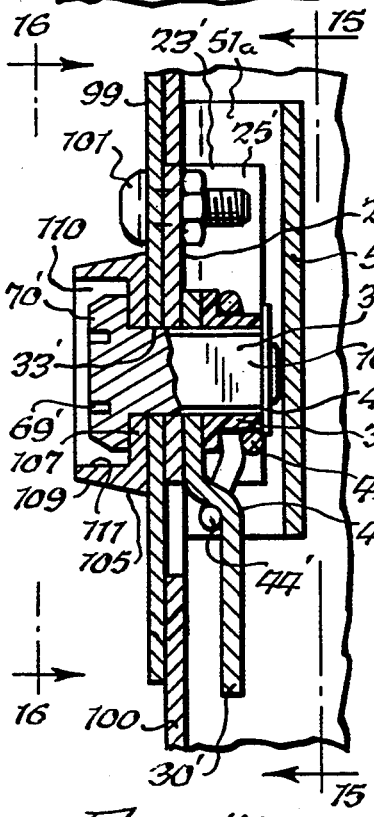
FIG. 14 is a fragmentary enlarged cross sectional view of the lock structure taken substantially along line 14—14 of FIG. 12.

The lock structure 22 includes a first channel 23 having a web 24 and legs 25. Channel 23 is secured to lower portion 17 of upper section 12 by a pair of rivets 27. A latch 29 has a head 30 and a portion 31 which is fixedly mounted against rotation on shaft 32 which is pivotally mounted in aperture 33 of web 24 (FIG. 8). Washers 34 and 35 space latch portion 31 from web 24. A disc 37 is pivotally mounted on cylindrical portion 39 (FIG. 4) of shaft 32 and is retained thereon by a C-ring 40. A spring 41 has a central portion 42 in encircling engagement with disc 37 and has one end bearing on the upper end 43 of leg 25 and its other end 44 underlying the bend 45 in latch member 29 to thereby bias latch 29 to the position shown in FIGS. 3 and 7 wherein the side 47 thereof bears against leg 25. This is the position that latch 29 assumes both when top section 12 is disassembled from bottom section 11 and when it is in a locking position, such as shown in FIGS. 3 and 5.

A second channel 49 having a web 50 and legs 51 and 51' is fixed to bottom section 11 by rivets 52 which extend through flanges 53 which extend outwardly from legs 51 and 51'. Leg 51' is longer than leg 51 in that the latter has a cutaway portion 54 (FIG. 3) at its upper end. The cutaway receives the head 30 of the latch at the beginning of the latching action (FIG. 7). The lower portion 55 of one leg 25 will engage the upper inner portion 57 of leg 51' (FIG. 7) while the head 30 of latch 29 is passing through cutaway portion 54 so as to act as a brace against the biasing force of spring 41 as the camming surface 59 of head 30 rides along the top portion of leg 51. The latter action cams latch 29 to a position wherein its tip 60 will ride along the inside of leg 51 until head 30 clears the lower end of leg 51, and the spring 41 will then bias head 30 to the position shown in FIGS. 3 and 5 wherein the horizontal portion 61 of latch 29 underlies the lower end of leg 51 to thereby cause the latch to be in a locked position to prevent upper section 12 from being moved upwardly away from lower section 11.

It can thus be seen that the uniquely integrated structure of lock 22 performs a plurality of functions. First of all, the legs 25 of channel 23 are in effective sliding engagement with legs 51 and 51' of channel 49 during the assembling of section 12 onto bottom section 11 and thus the engaged pairs of legs act as a guide. Furthermore, the lower end of leg 51 of channel 49 serves the additional function of being a keeper for latch head 30. Additionally, during installation of top section 12 onto bottom section 11, the top end of leg 51 serves as a member for camming latch 29 to a retracted unlocking position during installation prior to the time that spring 41 biases it to the locking position of FIG. 3. Additionally, if top section 12 should be rocked relative to bottom section 11 in an attempt to remove it while latch head 30 is in the position of FIG. 3, there is no way that latch head 30 can be moved out of locking engagement with the lower end of channel leg 51 because the two channels have to move in unison because their legs are in engagement.

Figure 3:
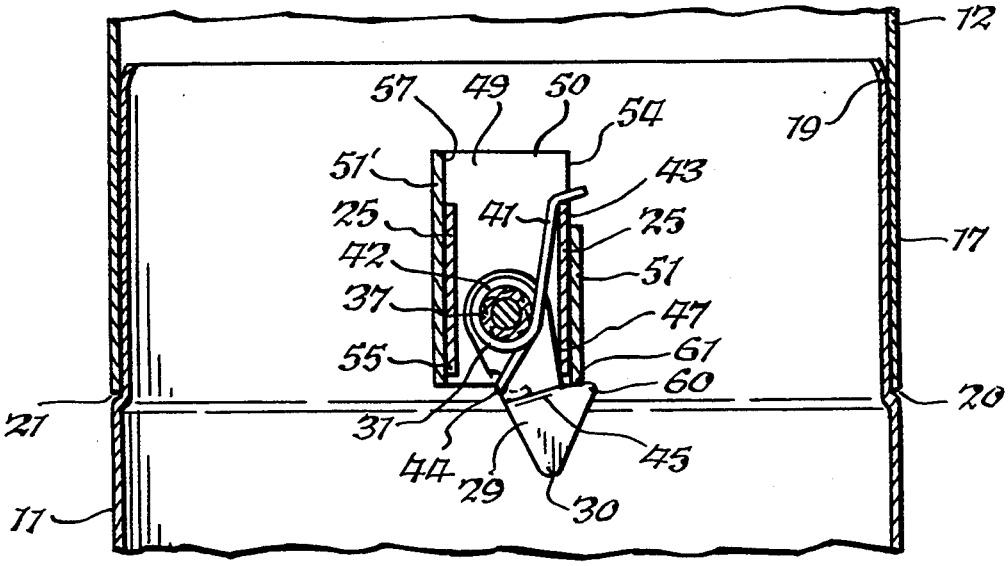
FIG. 3 is a fragmentary cross sectional view taken substantially along line 3—3 of FIG. 2.
Figure 6:
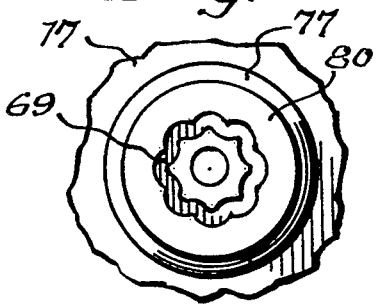
FIG. 6 is a fragmentary side elevational view taken substantially in the direction of arrows 6—6 of FIG. 4 and showing the configuration of the key-receiving structure.
Figure 11:
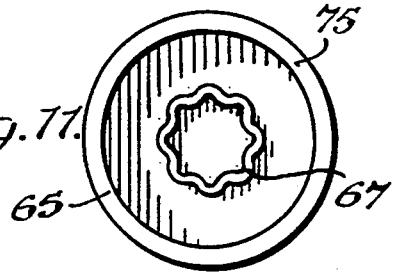
FIG. 11 is an end view of the key taken in the direction of arrows 11—11 of FIG. 10.

In order to unlock latch 30 from its position of FIG. 3, a key 62 is utilized. Key 62 has a handle 63, a shank 64 and a head 65 which has a ridge 67 (FIG. 11) therein which mates with groove 69 (FIG. 6) in head 70 of shaft 32. Also, annular rim 75 of key head 65 fits around outer edge 77 of head 70 of shaft 32 to thereby align the rotational axes of ridge 67 and groove 69 so that when key 62 is rotated and moved axially toward surface 80 which contains groove 69, ridge 67 will enter groove 69 when their configurations are in alignment. After ridge 67 has entered groove 69, handle 63 can be twisted in a clockwise direction in FIGS. 1 and 3 to cause latch head 30 to pivot clockwise from its locking position, and after head 30 clears the lower end of leg 51, top section 12 can be moved upwardly out of engagement with bottom section 11.

In FIGS. 12–16 another embodiment of the present invention is disclosed. In this embodiment the lock structure is substantially the same as shown in the preceding figures. The only major differences are that the grooved head of the latch mounting shaft has a rotatable collar mounted thereabout to impede access thereto with unauthorized tools and, further, the enclosure on which the lock is mounted is of a different construction.

Figure 2:
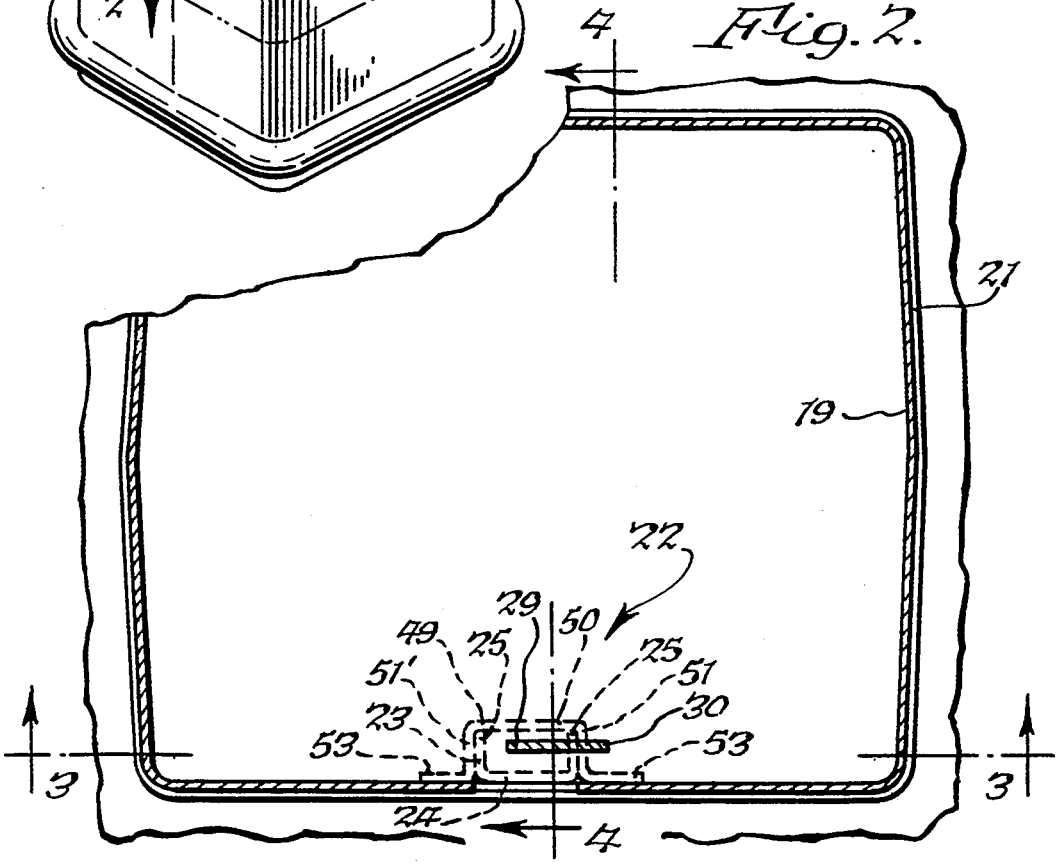
FIG. 2 is a fragmentary enlarged cross sectional view taken substantially along line 2—2 of FIG. 1 and showing portions of the lock structure.

The enclosure 10' is of the same general type as enclosure 10 of FIG. 1, and it includes a lower section 90 and an upper section 91 which can be telescopically mounted and demounted therefrom by movement in a rectilinear path. The upper section 91 has a lower peripheral edge 92, portions of which rest on tabs 93 which are cut out of and formed from the opposed front wall 94 and rear wall 94' of the bottom section 90 of the enclosure leaving openings 95 therein which serve no purpose other than to show how the tabs 93 were formed from lower section 90. The lock structure 97 is mounted relative to the front wall 99 of upper section 91 and the front wall 94 of lower section 90. More specifically, a first channel member 23', which corresponds to channel 23 of the preceding embodiment, is secured to front wall 99 by a pair of bolts 101, which pass through channel web 24'. Channel 23' has legs 25', which correspond to legs 25 of the preceding embodiment. Legs 25' are received within legs **51*a* and 51*b* of channel member 49' in the same manner as shown for the embodiment of FIGS. 1–11 in FIG. 2. Legs 51*a* and 51*b* correspond to legs 51 and 51' of channel member 49 of the preceding embodiment. Channel member 49' corresponds to channel member 49 of the preceding embodiments. Channel 49' has a web 50' which corresponds to web 50 of the preceding embodiment. The flanges 53' of channel 49', which correspond to flanges 53 of the preceding embodiment, are secured to wall 94 of lower section 90 by a pair of rivets 102. Leg 51*b* has a cutaway 54' which corresponds to cutaway 54 of the preceding figures. A latch 29' which may be identical to latch 29 of the preceding embodiment in all aspects thereof, has a rectangular opening 103 which fits onto rectangular portion 104 of shaft 32' which corresponds to and is identical to shaft 32 of the preceding figures. Shaft 32' is pivotally mounted in aperture 33' of wall 99. A disc 37', which is identical to disc 37 of FIG. 4, encircles shaft 32'. A collar 105 has an annular rim 107 which fits rotatably between head 70' of shaft 32' and front wall 99. The annular portion 109 of collar 105 surrounds head 70' which has the curvilinear groove 69' therein, and thus the annular sleeve portion 109 protects head 70' against meaningful access except for a key such as 62**.

A spring 41', which is identical to spring 41 of the preceding figures, has a central portion 42' which encircles disc 37', and it has one end bearing on the upper end of channel leg 25' and the other end 44' underlying bend 45' in latch member 29'. The shaft 32' and all parts which are mounted thereon are retained thereon by C-clip 40'.

Figure 15:
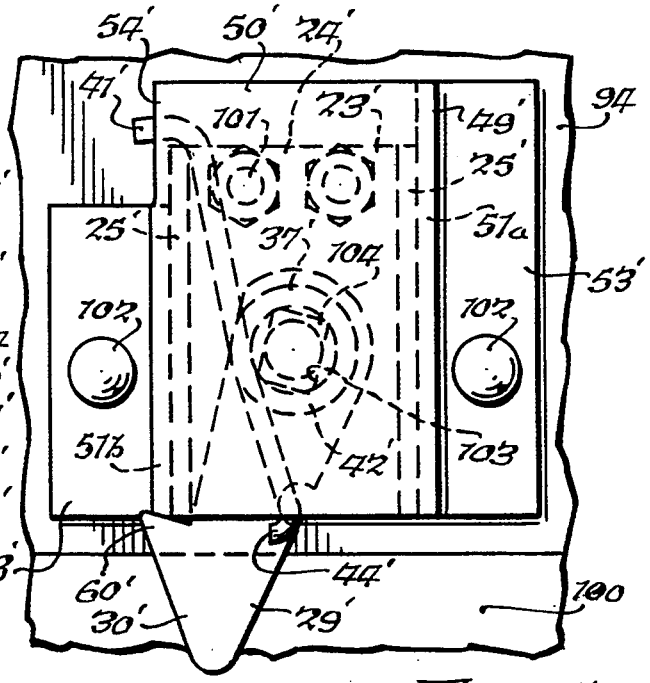
FIG. 15 is a fragmentary view taken substantially in the direction of arrows 15—15 of FIG. 14.

As in the preceding embodiment of FIGS. 1–11, when the upper enclosure section 99 is in a disassembled position from lower section 94, the latch 29' will be biased against leg 25' of channel 23'. When the upper section 99 is fully mounted on lower section 100, the latch head 30' will have its tip 60' underlying the lower end of leg 51*b*, as shown in FIG. 15.

Figure 16:
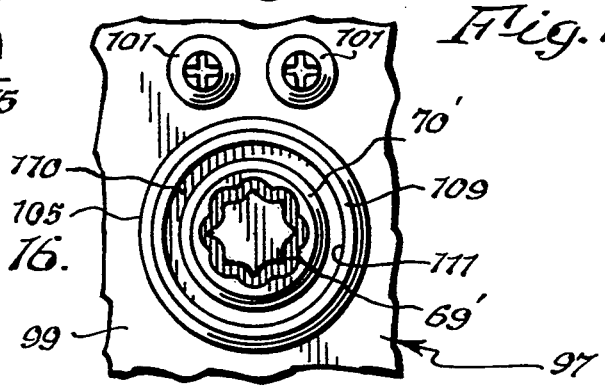
FIG. 16 is a fragmentary view taken substantially in the direction of arrows 16—16 of FIG. 14.

As can be seen from FIG. 16, there is an annular space 110 between annular portion 109 of collar 105 and shaft head 70' in which curvilinear groove 69' is located. The rim 75 (FIGS. 10 and 11) of key 52 fits into annular space 110, and it fits closely about shaft head 70' and closely to the internal surface 111 of annular portion 109.

The operation of the embodiment of FIGS. 12–16 during locking and unlocking is identical to the operation of the embodiment of FIGS. 1–11 described above, and it has the added benefit of the sleeve 105 which rotatably encircles shaft head 70'.

It will be appreciated that the concept of a ridged type of key configuration which fits into a curvilinear groove is a preexisting structure which forms no part of the present invention other than that it is utilized to latch and unlatch the lock structure.

While preferred embodiments of the present invention have been disclosed, it will be appreciated that it is not limited thereto but may be otherwise embodied within the scope of the following claims.

What is claimed is:

1. In an enclosure having first and second sections which are assembled and disassembled by a relative rectilinear sliding engagement, a lock structure comprising a first channel having a first web and a first pair of legs secured to said first section, a latch, pivot means pivotally mounting said latch on said first channel, spring means biasing said latch to a locking position, a second channel having a second web and a second pair of legs secured to said second section, said first pair of legs fitting between said second pair of legs and being located between said first and second webs when said first and second sections are being rectilinearly moved into assembled relationship and after said first and second sections are in fully assembled relationship, and an end on one of said second legs for functioning as a keeper for said latch when said first and second sections are in fully assembled locked relationship.

2. In an enclosure as set forth in claim 1 wherein said latch engages one of said first legs which functions as a stop for said latch against the bias of said spring when said first and second sections are disassembled, and wherein said latch includes a latching head which extends beyond said one of said second legs which acts as a keeper when said latch is in a locking position relative thereto.

3. In an enclosure as set forth in claim 2 wherein said latch includes a camming surface thereon for engaging said one of said second legs for pivoting said latch against the bias of said spring as said first and second channels move rectilinearly relative to each other toward a locked position of said latch.

4. In an enclosure as set forth in claim 3 wherein said one of said second legs has a cutaway portion at the end thereof remote from said end which functions as said keeper, and wherein the other one of said second legs is engaged by one of said first pair legs while said latch head passes through said cutaway portion, to thereby guide said first and second channels relative to each other during their movement toward said locked position of said latch.

5. In an enclosure as set forth in claim 1 wherein said pivot means comprises a shaft pivotally mounted relative to said first channel, a head on said shaft for receiving a key, and a collar surrounding said head.

6. In an enclosure as set forth in claim 5 wherein said collar is pivotally mounted on said shaft.

7. In an enclosure as set forth in claim 5 wherein said latch engages one of said first legs which functions as a stop for said latch against the bias of said spring when said first and second sections are disassembled, and wherein said latch includes a latching head which extends beyond said one of said second legs which acts as a keeper when said latch is in a locking position relative thereto.

8. In an enclosure as set forth in claim 7 wherein said latch includes a camming surface thereon for engaging said one of said second legs for pivoting said latch against the bias of said spring as said first and second channels move rectilinearly relative to each other toward a locked position of said latch.

9. In an enclosure as set forth in claim 8 wherein said one of said second legs has a cutaway portion at the end thereof remote from said end which functions as said keeper, and wherein the other one of said second legs is engaged by one of said first pair legs while said latch head passes through said cutaway portion, to thereby guide said first and second channels relative to each other during their movement toward said locked position of said latch.

* * * * *